US008660288B2

(12) United States Patent
Yamagishi

(10) Patent No.: US 8,660,288 B2
(45) Date of Patent: Feb. 25, 2014

(54) TWIN DRIVER EARPHONE

(75) Inventor: Makoto Yamagishi, Tokyo (JP)

(73) Assignee: Ocharaku Co. Ltd., Tokyo (JP)

( * ) Notice: Subject to any disclaimer, the term of this patent is extended or adjusted under 35 U.S.C. 154(b) by 0 days.

(21) Appl. No.: 13/809,861

(22) PCT Filed: May 9, 2012

(86) PCT No.: PCT/JP2012/003020

§ 371 (c)(1),
(2), (4) Date: Jun. 25, 2013

(87) PCT Pub. No.: WO2013/038581

PCT Pub. Date: Mar. 21, 2013

(65) Prior Publication Data

US 2013/0266170 A1 Oct. 10, 2013

(30) Foreign Application Priority Data

Sep. 12, 2011 (JP) ..... 2011-197811

(51) Int. Cl.
*H04R 1/28* (2006.01)

(52) U.S. Cl.
USPC ..... 381/372; 381/370; 381/354; 381/337; 381/345; 381/182

(58) Field of Classification Search
USPC ..... 381/312, 328, 150, 370, 372, 374, 379, 381/380, 382; 181/175, 128
See application file for complete search history.

(56) References Cited

FOREIGN PATENT DOCUMENTS

| | | |
|---|---|---|
| JP | 3160779 | 2/2011 |
| JP | 4681698 | 2/2011 |

*Primary Examiner* — Brian Ensey
*Assistant Examiner* — Sabrina Diaz
(74) *Attorney, Agent, or Firm* — Stoel Rives LLP

(57) ABSTRACT

Provided is a technique for improving frequency characteristics by an acoustics-related method so that a sound is heard with natural frequency characteristics when a sound-isolating earphone is fitted in a human ear. A sound-isolating earphone is provided with two or more electroacoustic transducers, wherein independently generated sound waves are passed through isolated sound leading pipes and are mixed just before an entrance of an external auditory canal, and a sound wave of which is twice the difference between path lengths of the two sound leading pipes is attenuated. This serves to provide an easy-to-hear improved sound quality by suppressing the sound wave at around 6 kHz that is transmitted with characteristically high intensity in a sound-isolating earphone.

5 Claims, 12 Drawing Sheets

TWIN DRIVER EARPHONE

TECHNICAL FIELD

The present invention relates to a sound-isolating earphone which is used with a sound-emitting portion thereof inserted in an entrance of an external auditory canal.

BACKGROUND ART

An ordinary sound-isolating earphone is configured as illustrated in FIG. 1, including an electroacoustic transducer 12 disposed inside a housing 11, a lead wire 125 which connects the electroacoustic transducer 12 to an external amplifier, for instance, a sound leading pipe 14 which transmits a sound wave generated by the electroacoustic transducer 12 to the external auditory canal, and an ear pad 15 which serves as a cushion when the earphone is inserted into the external auditory canal and also shuts off external noise.

The ear pad 15 having a sound outlet 16 at an extreme end of a portion inserted in the external auditory canal is made of soft plastic, rubber, or the like, having elasticity and fits in close contact with an inside wall of the external auditory canal without creating any gap. Consequently, the sound-isolating earphone constitutes an earplug structure as a whole. A sound-emitting portion of the electroacoustic transducer 12 is located in a closed space on a right side of a partitioning wall 13 as illustrated.

A sound-isolating earphone 2 can be securely fitted in the entrance of the external ear because the sound-isolating earphone 2 can be worn with the ear pad 15 inserted in the external auditory canal as illustrated in FIG. 2. Also, the ear pad 15 made of a material having flexibility can elastically deform with ease in accordance with the shape of the external auditory canal, making it possible to achieve a comfortable fit.

As a result, the sound-isolating earphone which is used by inserting the same in the entrance of the external auditory canal provides good acoustic isolation and high sound-sealing performance, so that external noise is less likely to be heard. This makes it possible to obtain high sound pressure sensitivity and hear a feeble sound even in a very noisy place. Also, this sound-isolating earphone provides an advantage that the same can easily be reduced in size and weight because the earphone is used by inserting the same in the entrance of the external auditory canal.

With the widespread use of portable music players in recent years, there is a growing demand for developing a sound-isolating earphone capable of outputting a high-quality sound.

Since the conventional sound-isolating earphone is structured to close off the external auditory canal, however, the state of resonance within the external auditory canal varies, causing a deviation of resonant frequency, between points in time before and after the earphone is fitted, and producing a serious defect with respect to frequency characteristics of the earphone.

Specifically, when the sound-isolating earphone is fitted as depicted in FIG. 2, there occurs a change in resonance mode because the earphone including the ear pad has the earplug structure which blocks the entrance of the external auditory canal as described in Patent Document 1. To be more specific, the resonance mode changes from one-end closed pipe resonance to both-end closed pipe resonance in which both ends are closed, the external auditory canal constituting a resonance box.

Consequently, as depicted in a graph of FIG. 3 representing sound pressure-frequency characteristics, the sound pressure at an eardrum position indicated by a broken line has peaks in ranges of 2.8 to 3.4 kHz and 8.5 to 10.2 kHz when the sound-isolating earphone is not fitted, whereas the peaks of the sound pressure at the eardrum position shift to positions in ranges of 5.7 to 6.8 kHz and 11.3 to 13.6 kHz as indicated by a solid line under the influence of closed-pipe resonance when the sound-isolating earphone is fitted.

For this reason, sound components at around 6 kHz are emphasized in the both-end closed pipe resonance mode when the sound-isolating earphone is fitted and, therefore, there has been a problem that a quasi-resonant state would be created, producing a buzzing echo sound.

To solve this problem, Patent Document 1 discloses a technique employing two isolated sound leading pipes having different path lengths as a sound leading portion which transfers a sound wave generated by an electroacoustic transducer of a sound-isolating earphone to the entrance of the external auditory canal. In this technique, two sound waves generated by the electroacoustic transducer and separately passed through the two sound leading pipes are recombined at an entrance of an external auditory canal to suppress the sound pressure of a frequency component of which half the wavelength equals a difference between the path lengths of the two sound leading pipes.

Also, Patent Document 2 discloses a technique employing an acoustic resistor (damper) mounted in a sound leading pipe so as to suppress high-frequency sound components with a capability to freely replace the acoustic resistor (damper) with a different one.

CITATION LIST

Patent Literature

Patent Document 1: Japanese Published Patent No. 4681698
Patent Document 2: Japanese Registered Utility Model No. 3160779

SUMMARY OF INVENTION

Technical Problem

According to the technique disclosed in Patent Document 1, however, it is necessary to design the two sound leading pipes having different path lengths, running parallel toward the entrance of the external auditory canal, to have a thickness that can fit in the entrance of the external auditory canal. Thus, each of the sound leading pipes should have a small cross-sectional area and, as a consequence, there arises a new problem that treble components are attenuated owing to viscosity resistance of air.

Also, according to the technique disclosed in Patent Document 2 which utilizes the acoustic resistor (damper), although the peak at around 6 kHz is generally suppressed and the buzzing echo sound is eliminated for sure, there arises a new problem that the sound pressure is reduced entirely over medium to high-frequency ranges.

Solution to Problem

The present invention has been made in light of the aforementioned problems. Accordingly, the invention provides a sound-isolating earphone used with a sound-emitting portion thereof inserted in an entrance of an external auditory canal, the sound-isolating earphone including at least two electroacoustic transducers, and sound leading pipes having different path lengths, the sound leading pipes being associated with the respective electroacoustic transducers, wherein sound waves generated by the at least two electroacoustic transducers at the same phase and passed through the respective sound leading pipes are combined at the entrance of the external auditory canal, and the sound pressure of a frequency component of which half the wavelength equals a difference between path lengths of the at least two sound leading pipes is suppressed.

A basic idea employed for solving the problems is described below, in which the double angle brackets << >> are used to express frequency characteristics. An earphone sound source refers to a sound output from a diaphragm of an electroacoustic transducer. Also, <<transfer function of one-end closed pipe resonance box>> refers to frequency characteristics represented by a sound transfer function with the external auditory canal used as a resonance box when the earphone is not fitted, and <<transfer function of both-end closed pipe resonance box>> refers to frequency characteristics represented by a sound transfer function with the external auditory canal used as a resonance box when the earphone is fitted.

When the earphone is not fitted, the following equation is satisfied:

<<sound pressure applied to eardrum>>=<<sound pressure applied to entrance of external auditory canal>>×<<transfer function of one-end closed pipe resonance box>>

Assuming here that a sound pressure equal to the sound pressure of the earphone sound source is applied to the entrance of the external auditory canal, there is a relationship expressed by the following equation:

<<sound pressure applied to entrance of external auditory canal>>=<<sound pressure of earphone sound source>>

Therefore,

<<sound pressure applied to eardrum>>=<<sound pressure of earphone sound source>>×<<transfer function of one-end closed pipe resonance box>> (1)

Then, when the sound-isolating earphone is fitted, the following equation is satisfied:

<<sound pressure applied to eardrum>>=<<sound pressure applied to entrance of external auditory canal>>×<<transfer function of both-end closed pipe resonance box>>

Also,

<<sound pressure applied to entrance of external auditory canal>>=<<sound pressure output from sound outlet of earphone>>=<<sound pressure of earphone sound source>>×<<transfer function of sound leading portion of sound-isolating earphone>>

Therefore,

<<sound pressure applied to eardrum>>=<<sound pressure of earphone sound source>>×<<transfer function of sound leading portion of sound-isolating earphone>>×<<transfer function of both-end closed pipe resonance box>> (2)

On the assumption that it is regarded as ideal if <<sound pressure applied to eardrum>> determined by equation (1) above is equal to that determined by equation (2) above, a relationship expressed by the following equation is obtained:

<<sound pressure of earphone sound source>>×<<transfer function of one-end closed pipe resonance box>>=<<sound pressure of earphone sound source>>×<<transfer function of sound leading portion of sound-isolating earphone>>×<<transfer function of both-end closed pipe resonance box>>

Rewriting the above equation in a simplified form, the following equation is obtained:

<<transfer function of sound leading portion of sound-isolating earphone>>=<<transfer function of one-end closed pipe resonance box>>×<<transfer function of both-end closed pipe resonance box>> (3)

According to this equation, the transfer function of the sound leading portion of the sound-isolating earphone on the left side is requested to create the below-described state. Specifically, what is meant by the numerator of the right side is that the characteristics of the one-end closed pipe resonance box achieved under conditions where the earphone is not fitted are reproduced under conditions where the sound-isolating earphone is fitted. Also, what is meant by the denominator of the right side is that characteristics which cancel out the characteristics of the both-end closed pipe resonance box generated by fitting the sound-isolating earphone are realized.

The inventor has found that the sound quality is substantially improved by realizing the characteristics indicated by the denominator of the right side of equation (3) above, or by suppressing sound components abnormally emphasized at around 6 kHz by sound isolation. The inventor has also found that if an entire sound volume is ensured, there is created almost no unpleasant feeling even if a sound pressure is not reproduced at around 3 kHz, because the entire sound volume is well maintained in accordance with the characteristics represented by the numerator of the right side of equation (3) above.

Specifically, since there are created characteristics involving a peak in a range of 5.7 to 6.8 kHz due to both-end closed pipe resonance using the external auditory canal as a resonance box, it is important that the frequency characteristics of the transfer function of the sound leading portion of the sound-isolating earphone suppress a sound component having the frequency of the peak.

Using a phenomenon in which a sound component of a particular frequency is attenuated when sound waves generated independently by two or more electroacoustic transducers at the same time and at the same phase are passed through two paths having different lengths and subsequently recombined, the present invention has realized this.

This type of sound-isolating earphone is named the twin-driver earphone, wherein the driver designates an electroacoustic transducer.

Advantageous Effects of Invention

Stated specifically, a sound-isolating earphone of the present invention used with a sound-emitting portion thereof inserted in an entrance of an external auditory canal, the earphone including two isolated sound leading pipes having different path lengths which are used as paths for transferring sound waves generated by two electroacoustic transducers to the external auditory canal, wherein the two sound waves passed through the two sound leading pipes are combined just before a sound outlet located near the entrance of the external auditory canal, and can suppress the sound pressure of a frequency component of which half the wavelength equals a difference between path lengths of the two sound leading pipes as well as the sound pressures of components of which frequencies are integer multiples of the aforementioned frequency component. It is therefore possible to prevent a reduction in sound volume in an entirety of sound ranges while suppressing sound pressure peaks at undesired frequencies caused by both-end closed pipe resonance. This confers an advantage that sound pressure-frequency characteristics which are in no way inferior to those achieved in a situation where the earphone is not worn can be realized.

Also, since the two electroacoustic transducers are used at the same time, there is produced an advantage that sound pressure sensitivity is increased in a manner equivalent to a case where an electroacoustic transducer having a large diameter is used. A further advantage is that an increased degree of freedom in layout is provided compared to a case where the large-diameter electroacoustic transducer is used.

Additionally, there is produced an advantage that the use of two or more small-diameter electroacoustic transducers is advantageous for sound reproduction in a high-frequency range compared to a case where the large-diameter electroacoustic transducer is used for increasing the sound pressure sensitivity.

DESCRIPTION OF EMBODIMENTS

Sound-isolating earphones (twin-driver earphones) according to the present invention are described herein below with reference to embodiments.

First Embodiment

Figure 4:
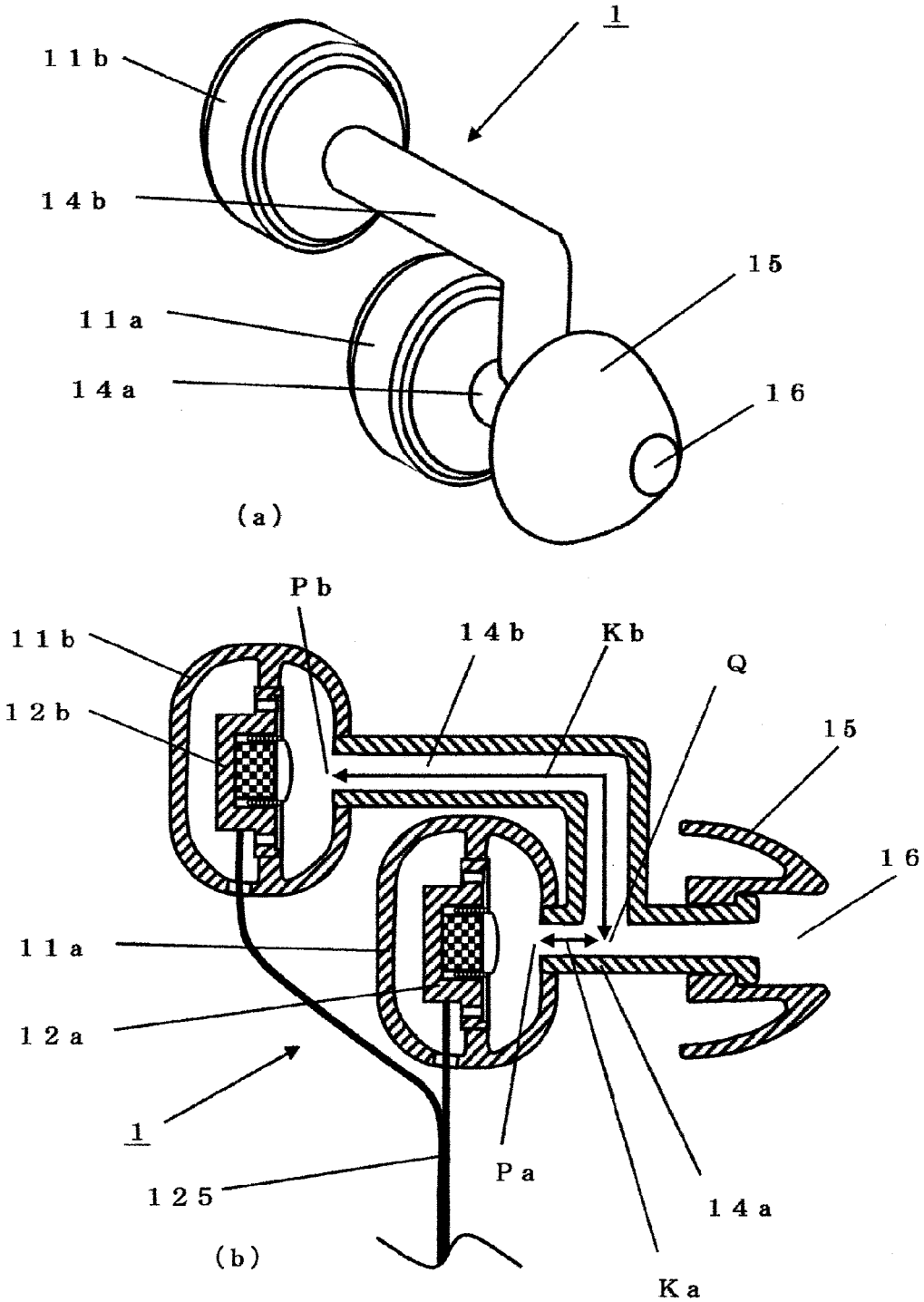
FIG. 4 is a representation of a sound-isolating earphone provided with two electroacoustic transducers.

FIG. 4 is a diagram of a sound-isolating earphone (twin-driver earphone) provided with two independent electroacoustic transducers and sound leading pipes, wherein FIG. 4(*a*) is a schematic view and FIG. 4(*b*) is a cross-sectional view.

Figure 1:
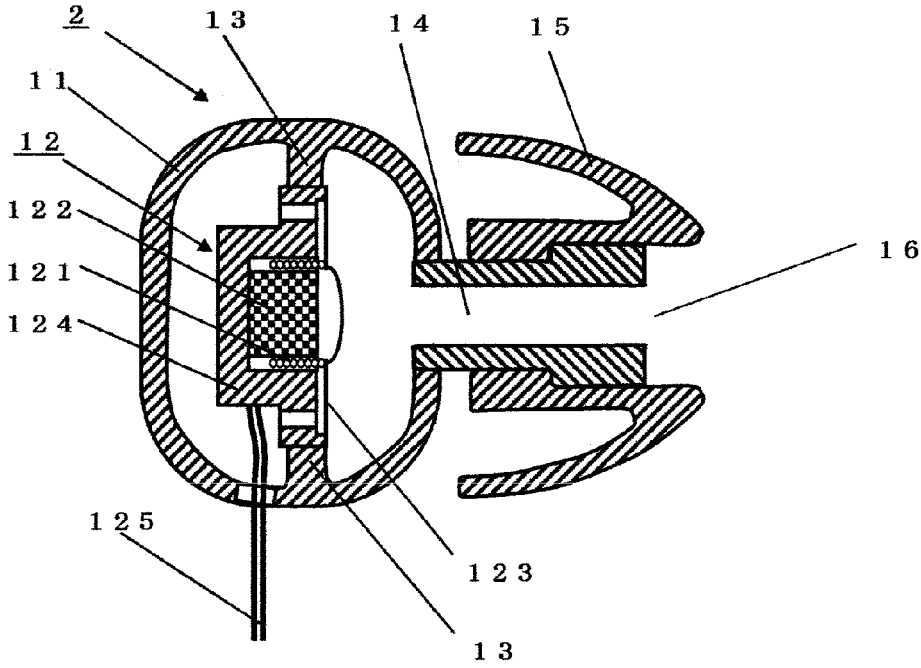
Fig. 1 (Prior Art)
FIG. 1 is a cross-sectional diagram depicting an internal structure of a sound-isolating earphone.
Figure 2:
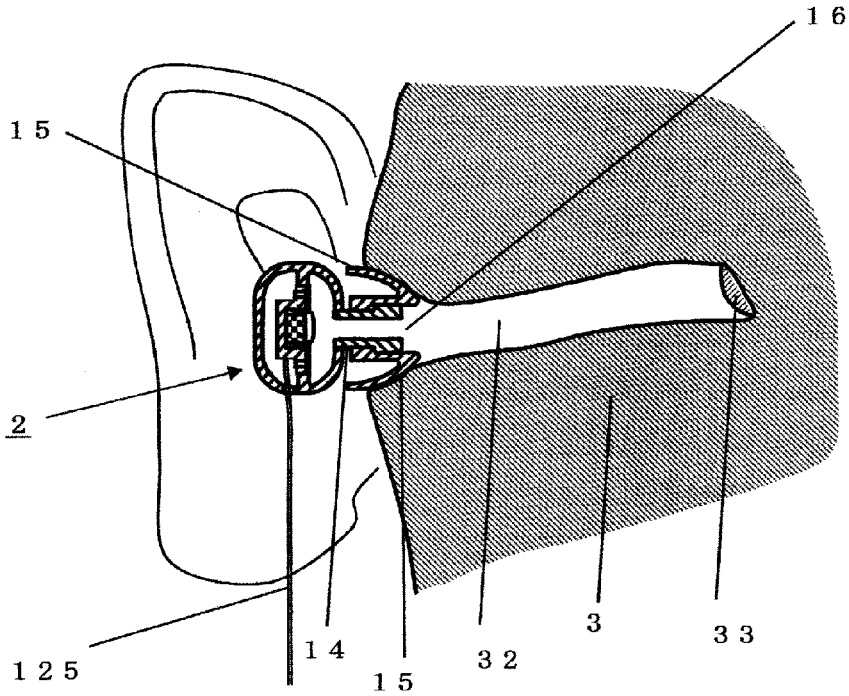
Fig. 2 (Prior Art)
FIG. 2 is a diagram depicting how the sound-isolating earphone is worn.
Figure 3:
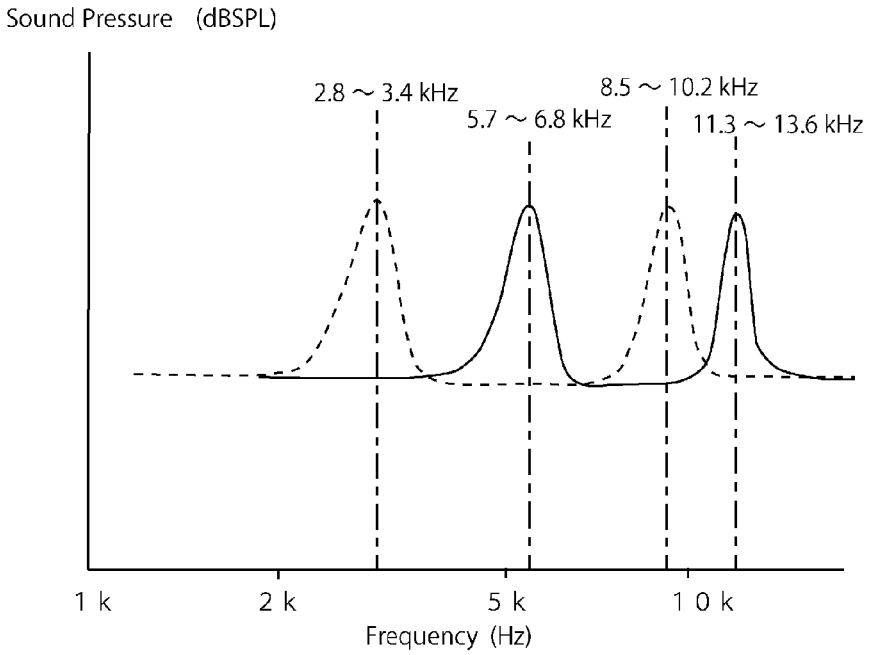
Fig. 3 (Prior Art)
FIG. 3 is a chart representing sound pressure-frequency characteristics of the sound-isolating earphone at an eardrum position.

One housing of the sound-isolating earphone (twin-driver earphone) has the same internal structure as that of the ordinary sound-isolating earphone illustrated in FIG. 1. The sound-isolating earphone (twin-driver earphone) 1 is configured as illustrated in FIG. 4(*b*), including a first electroacoustic transducer 12*a* built in a first housing 11*a* associated with a first sound leading pipe 14*a*, a second electroacoustic transducer 12*b* built in a second housing 11*b* associated with a second sound leading pipe 14*b*, an ear pad 15, and a lead wire 125 which connects the two electroacoustic transducers 12*a*, 12*b* to an unillustrated audio amplifier.

The electroacoustic transducer 12 includes a coil 121, a permanent magnet 122, a diaphragm 123 and a yoke 124 as depicted in FIG. 1. When a current having an acoustic waveform is flowed through the coil, the diaphragm vibrates in accordance with the acoustic waveform and a sound wave is emitted rightward toward the sound leading pipe 14 as depicted in FIG. 1.

The housing 11 and the sound leading pipe 14 are produced by molding hard plastic or metal, for example. The ear pad 15 is produced by molding soft plastic or rubber, for example.

The sound leading pipe 14 is fixed to the housing 11 by an appropriate method which is not illustrated. The ear pad 15 is inserted into the sound leading pipe 14 over a protrusion formed at an extreme end of the sound leading pipe 14 using elasticity of the ear pad 15 and fixed in position. The ear pad 15 is replaceable as appropriate to fit the size of an entrance of a user's external ear.

The electroacoustic transducer 12 is fixed to the housing 11 by an appropriate method which is not illustrated.

While the electroacoustic transducers 12*a* and 12*b* depicted in FIG. 4 are of a so-called dynamic type, the electroacoustic transducers 12*a* and 12*b* may be any of other types, such as a magnetic type.

As depicted in FIG. 4, the first sound leading pipe 14*a* extends straight from a front face of the housing 11*a* and reaches as far as a sound outlet 16. The second sound leading pipe 14*b* which extends straight from a front face of the housing 11*b* is diverted midway to a downward direction and is joined to a hole formed in the first sound leading pipe 14*a* at a halfway point thereof without creating any gap at a merging point Q where the second sound leading pipe 14*b* meets the first sound leading pipe 14*a*. The first sound leading pipe 14*a* has a path length Ka while the second sound leading pipe 14*b* has a path length Kb, wherein there is a relationship expressed by Ka<Kb.

A first sound wave generated by the first electroacoustic transducer 12*a* passes through an entrance Pa of the first sound leading pipe 14*a* and reaches the merging point P. A second sound wave generated by the second electroacoustic transducer 12*b* passes through an entrance Pb of the second sound leading pipe 14*b* and reaches the merging point Q. The two sound waves mix with each other at the merging point Q, and a combined sound wave is emitted from the sound outlet 16 and enters a wearer's external auditory canal 32.

If sound waves of the same phase emitted from two independent sound sources individually pass through independent paths and are mixed at outlets of the paths with a 180-degree phase difference caused by a difference in path length, it is apparent that a combined sound wave has zero amplitude.

This is expressed by a mathematical expression given below. Assuming that the two electroacoustic transducers 12 generate sound waves of the same frequency and phase, and expressing the amplitude of the sound wave at point Pa by Pa(ω) and the amplitude of the sound wave at point Pb by Pb(ω) (where ω is angular velocity):

$$Pa(\omega)=Pb(\omega)$$

The above equation can be further written as follows:

$$Pa(\omega)=Pb(\omega)=2A\sin(\omega t)$$

(where t is time and A is an arbitrary constant.)

A signal Q(ω) obtained when the two sound waves which have passed through the separate paths are combined at the merging point Q is expressed as follows:

$$Q(\omega)=Pa(\omega)+Pb(\omega)=A\sin\omega t+A\sin(\omega t+\omega L/V)$$

where V is sound velocity and L is the difference between the path lengths.

The above equation can be rewritten as follows because the waveform remains unchanged even if a waveform observation point is shifted forward by as much as L/2V:

$$\begin{aligned} Q(\omega) &= A\sin(\omega t-\omega L/2V)+A\sin(\omega t+\omega L/2V) \\ &= 2A\sin(\omega t)\cdot\cos(\omega L/2V) \\ &= Pa(\omega)\cdot\cos(\omega L/2V) \\ &= Pb(\omega)\cdot\cos(\omega L/2V) \end{aligned} \tag{4}$$

From equation (4) above, transfer function $T_{PQ}$ of a waveform which reaches point Q from point Pa or Pb is expressed as follows:

$$T_{PQ}\propto\cos(\omega L/2V)$$

Thus, transfer function $T_{PQ}'$ of the sound pressure is given by $$T_{PQ}'\propto|\cos(\omega L/2V)|$$

Using the relationship ω=2πf, the above mathematical expression can be rewritten as follows:

$$T_{PQ}'\propto|\cos(\pi fL/V)| \tag{5}$$

(where f is frequency.)

Figure 5:
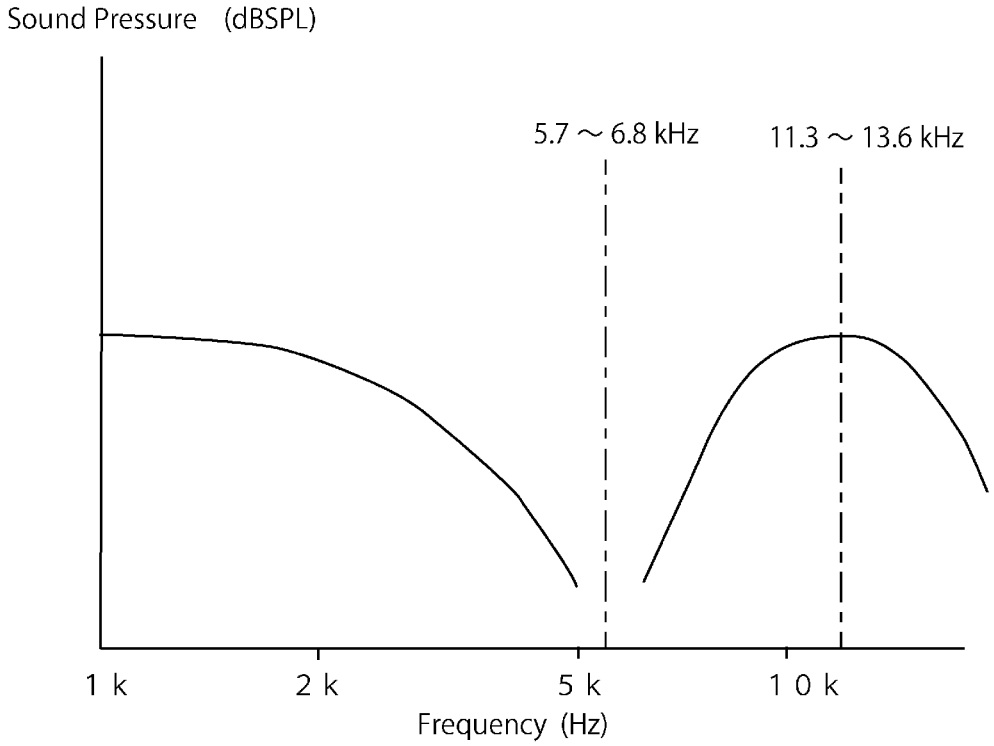
FIG. 5 is a chart representing sound pressure-frequency characteristics of two sound leading pipes having a difference in path length.

FIG. 5 is a graphical representation by solid lines of mathematical expression (5) above, that is, transfer function $T_{PQ}'$ of the sound leading pipes of the sound-isolating earphone in which the sound waves that are combined after passing through the separate paths having a difference in path length of 25 to 30 mm (which corresponds to an average length of the external auditory canal), wherein it is assumed that the sound velocity is 340 m/s.

This transfer function corresponds to <<transfer function of both-end closed pipe resonance box>>$^{-1}$ which is the second term on the right side of the equation which gives <<transfer function of sound leading portion of sound-isolating earphone>> indicated in equation (3). The transfer function serves to suppress characteristics emphasized by the both-end closed pipe resonance box.

Specifically, if 2(Kb−Ka)=2L=V/f (indicating that twice the difference in path length equals the wavelength) in mathematical expression (5) above, frequency characteristics represented by the transfer function exhibit a valley at a frequency of f=V/2L. This means that the sound waves are attenuated at around a frequency of 6 kHz when (Kb−Ka)=25 to 30 mm in this embodiment.

Figure 6:
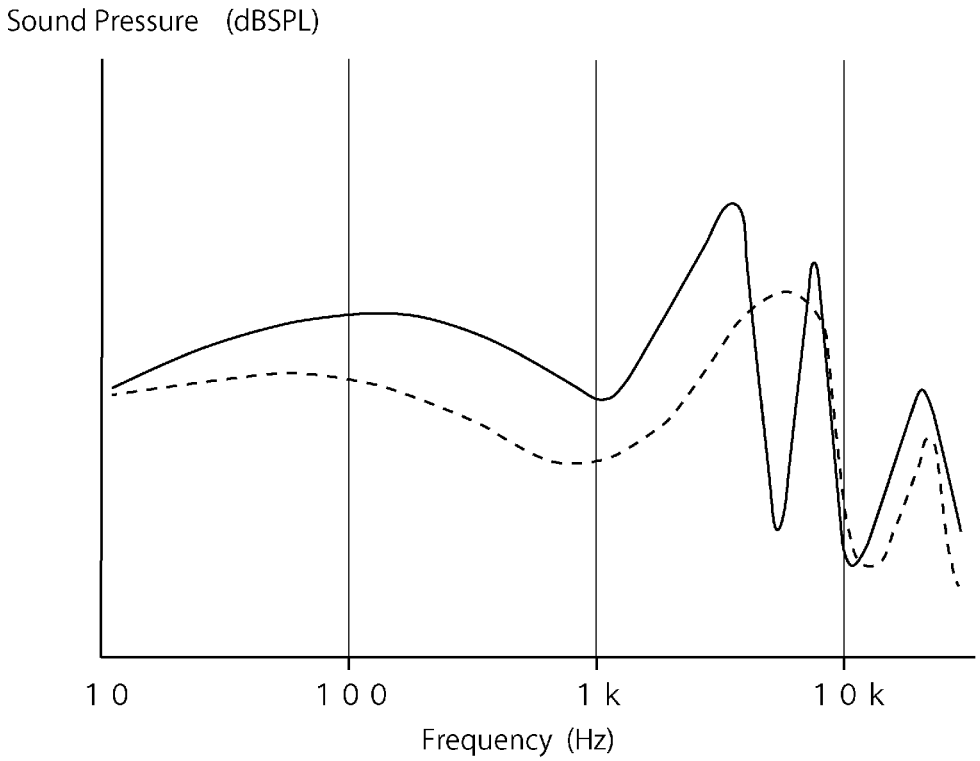
FIG. 6 is a chart representing sound pressure-frequency characteristics of the sound-isolating earphone provided with the two electroacoustic transducers.

FIG. 6 is a graphical representation of measurement results of sound pressure-frequency characteristics of the sound-isolating earphone (twin-driver earphone) configured as depicted in FIG. 4, wherein a solid line represents the characteristics of the twin-driver earphone of the present invention in which the sound leading pipes have a difference in path length of 28 mm, and a broken line indicated in a superimposed manner represents the characteristics of an earphone having an ordinary simple structure provided with a single electroacoustic transducer.

Measurement of the sound pressure-frequency characteristics was performed upon reproducing actual conditions of use with the sound-isolating earphone (twin-driver earphone) and a microphone used for measurement placed in a closed environment.

From a comparison between the characteristics of both earphones, it is recognized that the sound pressure is intensely suppressed at around 6 kHz whereas a peak level at around 12 kHz is increased in the treble range which affects the sound quality in the twin-driver earphone as compared to the simple sound-isolating earphone.

What is important here is that the present invention suppresses the characteristics which used to produce a high peak at around 6 kHz, eliminating a buzzing echo sound. Also, the cross-sectional area of each sound leading pipe is increased, treble components are no longer attenuated owing to viscosity resistance of air, and sound pressure characteristics in the treble range up to around 12 kHz that affects the sound quality are significantly improved.

It has been possible to avoid a reduction in sound volume in an entirety of sound ranges in the above-described manner while suppressing sound pressure peaks at undesired frequencies caused by both-end closed pipe resonance. This confers an advantage that sound pressure-frequency characteristics which are in no way inferior to those achieved in a situation where the earphone is not worn can be realized.

Also, since the two electroacoustic transducers are used at the same time, there is produced an advantage that sound pressure sensitivity is increased in a manner equivalent to a case where an electroacoustic transducer having a large diameter is used. A further advantage is that an increased degree of freedom in layout is provided compared to a case where the large-diameter electroacoustic transducer is used.

Additionally, there is produced an advantage that the use of two or more small-diameter electroacoustic transducers is advantageous for sound reproduction in a high-frequency range compared to a case where the large-diameter electroacoustic transducer is used for increasing the sound pressure sensitivity.

Second Embodiment

Figure 7:
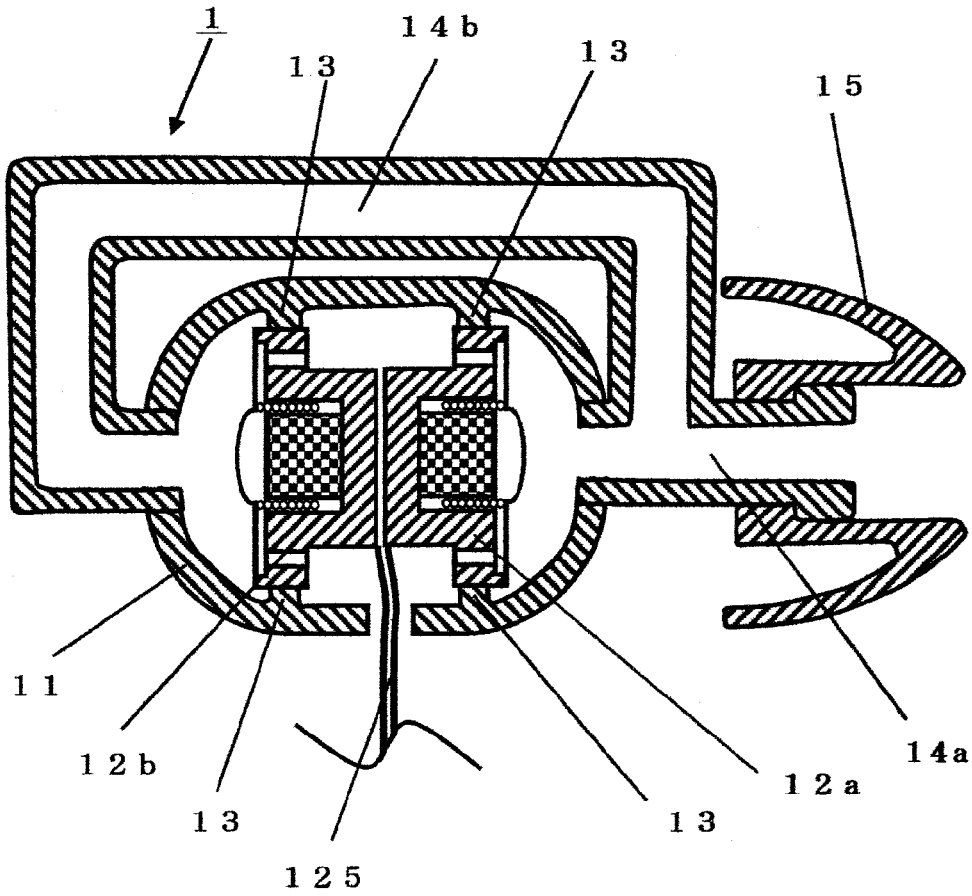
FIG. 7 is a cross-sectional diagram of a sound-isolating earphone provided with two electroacoustic transducers which are disposed in opposite directions.

A second embodiment is described with reference to FIG. 7. FIG. 7 is a cross-sectional diagram of a sound-isolating earphone provided with two electroacoustic transducers which are disposed in opposite directions. The Figure depicts an example in which two electroacoustic transducers 12 are arranged back to back in a single housing 11. The foregoing discussion of the first embodiment applies also to such an arrangement.

As depicted in FIG. 7, the two electroacoustic transducers 12*a* and 12*b* are arranged in the opposite directions along an arrangement axial line A-A' which connects central points of respective diaphragms to each other. Here, the arrangement axial line A-A' is parallel or generally parallel to the direction of a sound wave emitted from a sound outlet 16.

Although mechanical vibrations produced when the electroacoustic transducers 12 generate sounds become a source of noise (distortion) by moving the diaphragm, it is possible to cancel out the mechanical vibrations and obtain a higher sound quality in this embodiment. This is because the embodiment employs an arrangement in which the mechanical vibrations are oriented in the opposite directions and have the same magnitude.

Figure 8:
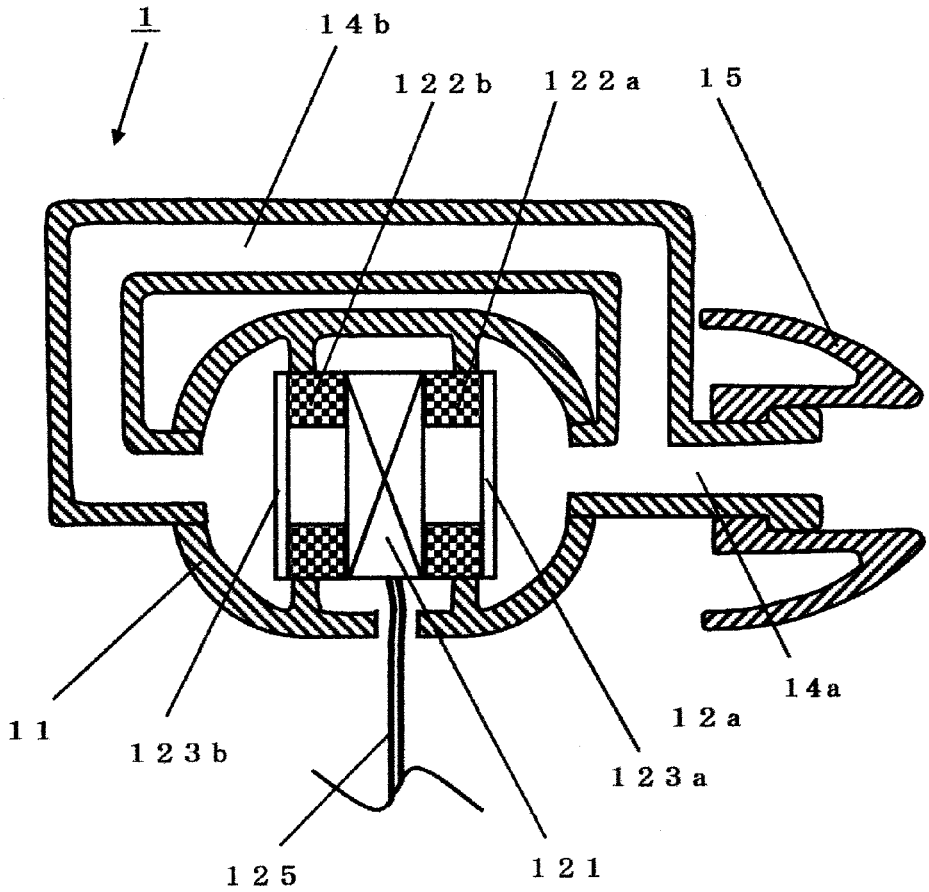
FIG. 8 is a cross-sectional diagram of single-structured electroacoustic transducers disposed in opposite directions.

FIG. 8 depicts another example in which two electroacoustic transducers 12 oriented in opposite directions are arranged in one outer housing. The electroacoustic transducers 12 are of a magnetic type, in which a single coil 121 simultaneously drives two diaphragms 123*a* and 123*b*. Specifically, if a permanent magnet 122*a* and a permanent magnet 122*b* are arranged such that the polarity of the former and that of the latter are oriented symmetrically about the coil 121, it is possible to simultaneously drive the diaphragms 123*a* and 123*b* in the opposite directions. With the provision of this means, only one coil is required, thereby allowing a reduction in physical dimensions, weight and cost.

Additionally, sound-emitting directions need not necessarily be the opposite directions but may be directions deviating by 90 degrees from each other. Although it is not possible to cancel out unwanted vibrations of the diaphragms in this case, there is produced the same advantage that the degree of freedom in arrangement of the electroacoustic transducers is provided as described above.

Other advantages are the same as discussed in the first embodiment.

Third Embodiment

A third embodiment is a sound-isolating earphone (twin-driver earphone) used with a sound-emitting portion thereof inserted in an entrance of an external auditory canal, the sound-isolating earphone (twin-driver earphone) being characterized by including two or more electroacoustic transducers and sound leading pipes having different path lengths, the sound leading pipes being associated with the respective electroacoustic transducers, wherein sound waves generated by the two or more electroacoustic transducers at the same phase and passed through the respective sound leading pipes are combined at the entrance of the external auditory canal, the sound pressure of a frequency component of which half the wavelength equals a difference among path lengths of the two or more sound leading pipes is suppressed, and an acoustic resistor is disposed in each sound-conducting path of all or part of the two or more sound leading pipes.

Figure 9:
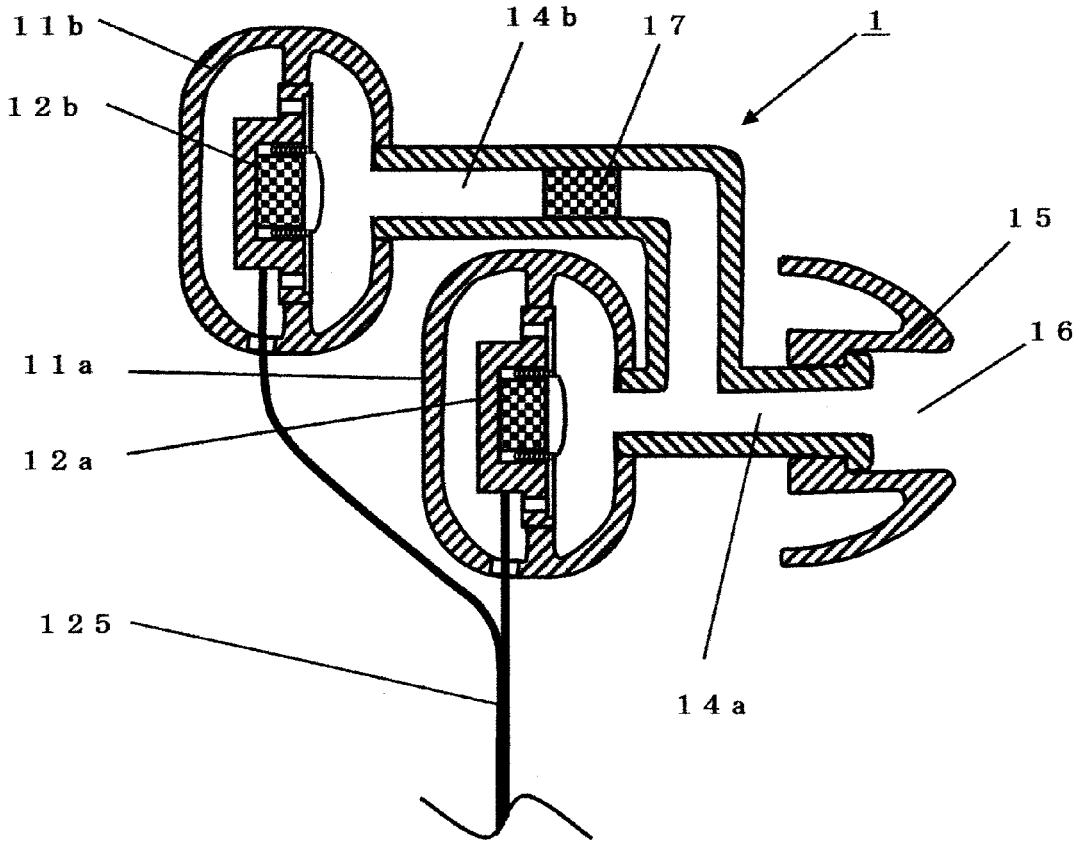
FIG. 9 is a cross-sectional diagram of a sound-isolating earphone having an acoustic resistor.

The third embodiment is described with reference to FIG. 9. A cross-sectional diagram depicted in FIG. 9 is the same as that of the sound-isolating earphone (twin-driver earphone) depicted in FIG. 4 except that an acoustic resistor 17 is disposed in a path formed in a sound leading pipe 14*b*. The acoustic resistor 17 is an object obtained by shaping plastic foam or cotton or rounding fine metal threads that exerts an effect to attenuate high-frequency components of the sound which is passed.

It is possible to attenuate the sound wave emitted from a second electroacoustic transducer by disposing the acoustic resistor 17. This enables adjustment of how much sound wave components at around 6 kHz are to be eliminated as well as adjustment of the sound quality according to the user's personal preference.

Other advantages are the same as discussed in the first embodiment.

Fourth Embodiment

A fourth embodiment is a sound-isolating earphone used with a sound-emitting portion thereof inserted in an entrance of an external auditory canal, the sound-isolating earphone being characterized by including two or more electroacoustic transducers and sound leading pipes having different path lengths, the sound leading pipes being associated with the respective electroacoustic transducers, wherein sound waves generated by the two or more electroacoustic transducers at the same phase and passed through the respective sound leading pipes are combined at the entrance of the external auditory canal, the sound pressure of a frequency component of which half the wavelength equals a difference among path lengths of the two or more sound leading pipes is suppressed, and an entirety or part of the length of each of the two or more sound leading pipes is made replaceable so as to vary the path length, thereby altering the difference among the path lengths.

Figure 10:
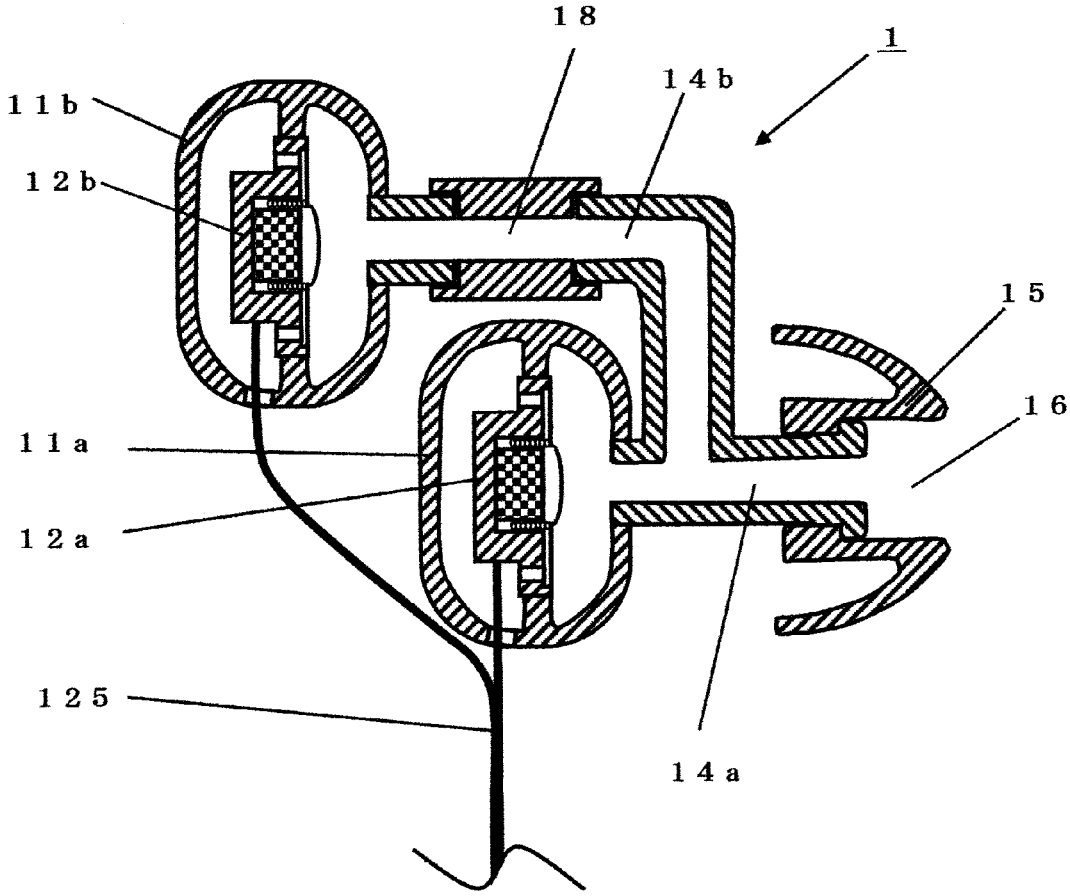
FIG. 10 is a cross-sectional diagram of a sound-isolating earphone of which a part of sound leading pipes is replaceable.

The fourth embodiment is described with reference to FIG. 10. Although a cross-sectional diagram depicted in FIG. 10 is basically the same as that of the sound-isolating earphone (twin-driver earphone) depicted in FIG. 4, the former differs from the latter in that part of a sound leading pipe 14*b* is made replaceable.

Part of the sound leading pipe 14*b* is cut away halfway along the length thereof. After part of the sound leading pipe 14*b* has been cut away, a connecting pipe 18 is placed in position and end portions of cut parts of the sound leading pipe 14*b* are inserted into both ends of the connecting pipe 18 to form an uninterrupted pipe.

It is also possible to make the entirety of the sound leading pipe 14*b* replaceable.

According to the above-described arrangement, it is possible to match the overall length of the sound leading pipe 14*b* with the length of the user's external auditory canal by altering the length of the connecting pipe 18, making it possible to correctly attenuate a sound wave having the same frequency as the closed-pipe resonant frequency of the user's external auditory canal.

Other advantages are the same as discussed in the first embodiment.

Fifth Embodiment

A fifth embodiment is a sound-isolating earphone used with a sound-emitting portion thereof inserted in an entrance of an external auditory canal, the sound-isolating earphone being characterized by including two or more electroacoustic transducers and sound leading pipes having different path lengths, the sound leading pipes being associated with the respective electroacoustic transducers, wherein sound waves generated by the two or more electroacoustic transducers at the same phase and passed through the respective sound leading pipes are combined at the entrance of the external auditory canal, the sound pressure of a frequency component of which half the wavelength equals a difference among path lengths of the two or more sound leading pipes is suppressed, a regulating valve is disposed in each of all or part of the two or more sound leading pipes at a halfway point thereof, and the cross-sectional area of a sound-conducting path is varied by adjusting an inserting position of the regulating valve.

The fifth embodiment is described with reference to FIG. 11. Although a cross-sectional diagram depicted in FIG. 11(*a*) is basically the same as that of the sound-isolating earphone (twin-driver earphone) depicted in FIG. 4, the former differs from the latter in that an opening/closing mechanism 19 is disposed in a sound leading pipe 14*b* so that the cross-sectional area of the sound-conducting path can be mechanically varied.

Figure 11:
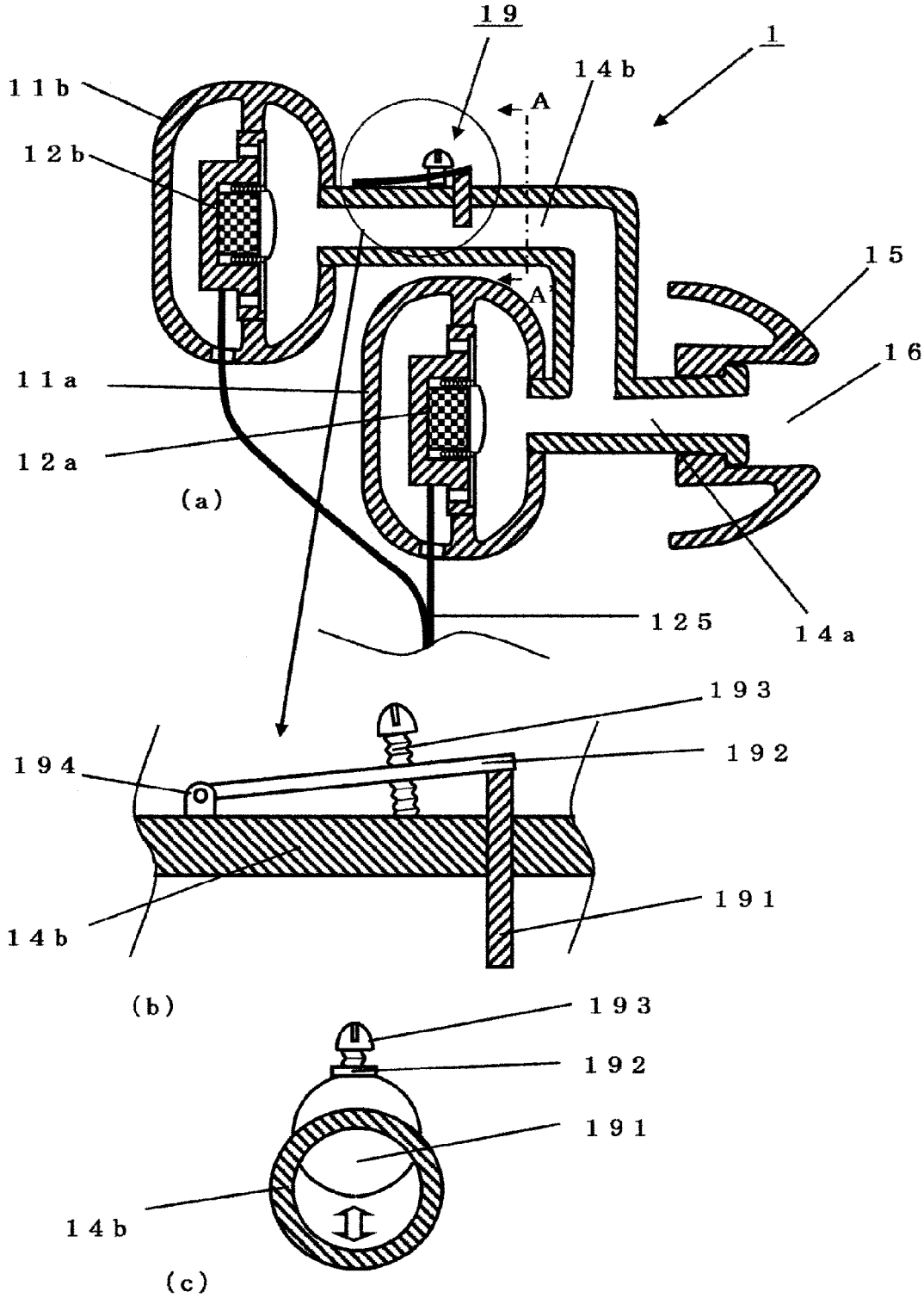
FIG. 11 is a cross-sectional representation of a sound-isolating earphone in which the cross-sectional area of a sound leading pipe is variable.

FIG. 11(*b*) is a schematic diagram of the opening/closing mechanism 19 illustrating an enlarged view of a portion surrounded by a circle in FIG. 11(*a*). Also, FIG. 11(*c*) is a cross-sectional front view of the opening/closing mechanism 19 taken at a position indicated by line A-A' in FIG. 11(*a*).

An extreme end of a spring 192 is bonded to an upper end of a regulating valve 191 by an appropriate method and the other end of the spring 192 is pivotally supported by a fulcrum 194. A middle portion of the spring 192 is internally threaded and the height of the extreme end thereof is made adjustable by an adjusting screw 193 which passes through relevant internal threads. When the adjusting screw 193 is turned, the regulating valve 191 moves up or down.

As depicted in FIG. 11(*c*), it is possible to vary an area in which the sound-conducting path 14*b* is blocked by moving the regulating valve 191 up or down. The amount of attenuation of the 6-kHz sound wave becomes smaller when the area of the sound-conducting path is reduced. The user can adjust the sound quality according to his or her personal preference.

Other advantages are the same as discussed in the first embodiment.

Sixth Embodiment

Figure 12:
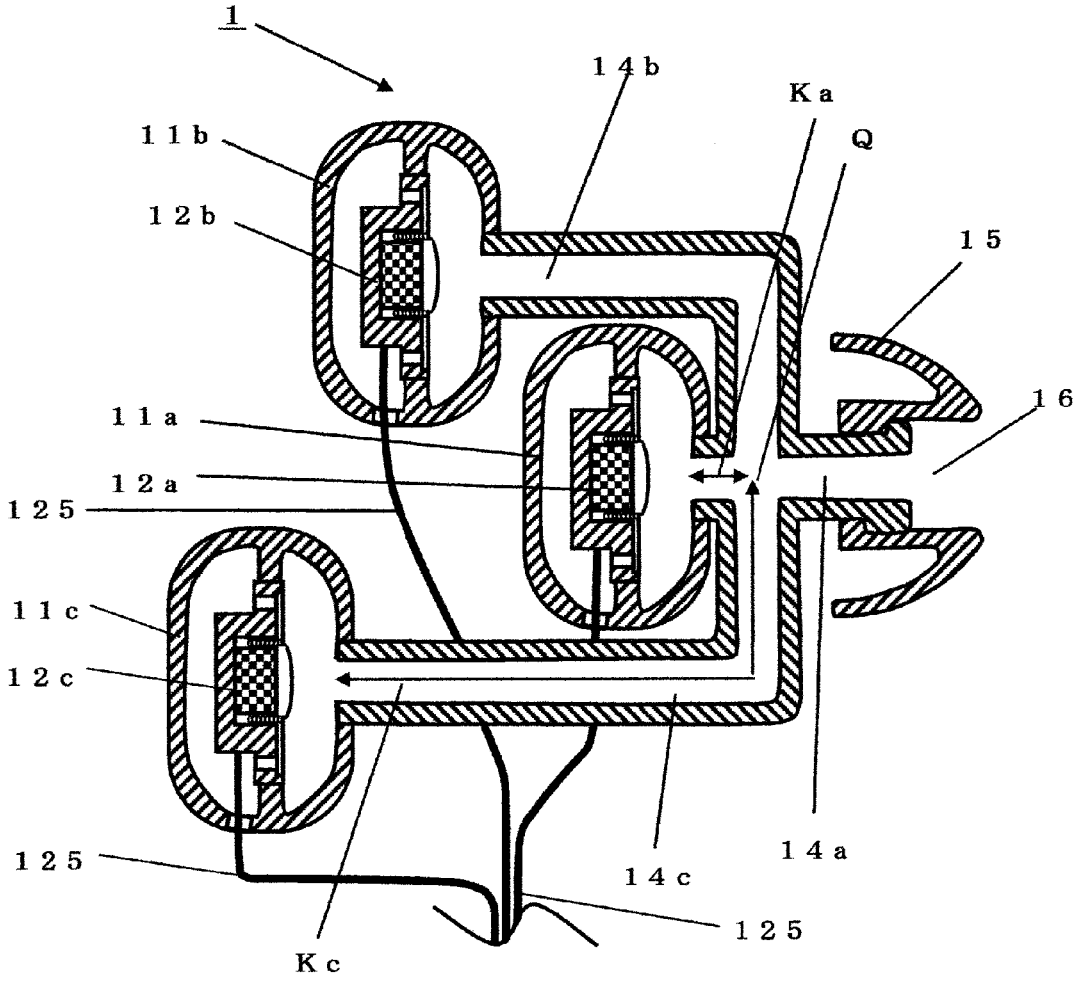
FIG. 12 is a cross-sectional diagram of a sound-isolating earphone provided with three electroacoustic transducers.

A sixth embodiment is a case in which there exist three electroacoustic transducers. The sixth embodiment is described with reference to FIG. 12. In this cross-sectional diagram, there are provided, in addition to a case including the two electroacoustic transducers depicted in FIG. 4, a third housing 11*c* and electroacoustic transducer 12*c* which are disposed on an opposite side of the second housing with the first housing 11*a* located in between.

The three electroacoustic transducers generate sound waves of the same phase.

A third sound leading pipe 14*c* which extends from a front face of a housing 11*b* is diverted midway to an upward direction and is joined to a hole formed in the first sound leading pipe 14*a* at a halfway point thereof without creating any gap at a merging point Q where the third sound leading pipe 14*c* meets the first sound leading pipe 14*a*. At the merging point Q, the sound waves generated independently by the three electroacoustic transducers meet together and become combined.

Expressing the path length of the third sound leading pipe 14*c* by Kc, a sound wave component of which wavelength is twice the difference in path length (Kc−Ka) between the path length Kc of the third sound leading pipe 14*c* and the path length Ka of the first sound leading pipe 14*a* is newly attenuated herein. For example, if (Kc−Ka)=38 mm, sound waves of which frequencies are approximately 4.47 kHz and approximately 8.95 kHz which is twice the former frequency are attenuated.

Taking also into consideration interference with the second sound leading pipe 14*b* at this time, if (Kb−Ka)=28 mm, (Kc−Kb)=10 mm, so that calculation indicates that a 17-kHz sound wave is attenuated. This has no substantial influence, however, because such a high frequency is actually almost inaudible by the human sense of hearing.

It is possible to adjust attenuation of sound waves of a plurality of frequencies by choosing the path lengths of the three sound leading pipes in the above-described manner. Furthermore, there may be provided four or five electroacoustic transducers, for instance, which will make it possible to realize an earphone having frequency characteristics suited to the preference of each user over a wide frequency range.

Other advantages are the same as discussed in the first embodiment.

REFERENCE SIGNS LIST

1 Sound-isolating earphone
11 Housing
12 Electroacoustic transducer (driver)
121 Coil
122 Permanent magnet
123 Diaphragm
124 Yoke
125 Lead wire
13 Partitioning wall
14 Sound leading pipe
15 Ear pad
16 Sound outlet
17 Acoustic resistor
18 Connecting pipe
19 Opening/closing mechanism
191 Regulating valve
192 Spring
193 Adjusting screw
194 Fulcrum
2 Sound-isolating earphone
3 Human body
31 Entrance of external auditory canal
32 External auditory canal
33 Eardrum
A-A' Arrangement axial line
K Path length of sound leading pipe
P Entrance
Q Merging point

The invention claimed is:

1. A sound-isolating earphone used with a sound-emitting portion thereof inserted in an entrance of an external auditory canal, the sound-isolating earphone comprising:

at least two electroacoustic transducers; and at least two sound leading pipes having different path lengths, each sound leading pipe being associated with a respective electroacoustic transducer;

wherein sound waves generated by the at least two electroacoustic transducers at the same phase and passed through the respective sound leading pipes are combined at the entrance of the external auditory canal, and wherein the sound pressure of a frequency component of which half the wavelength equals a difference between path lengths of the at least two sound leading pipes is suppressed.

2. The sound-isolating earphone according to claim 1, wherein the difference between the path lengths of the at least two sound leading pipes is substantially equal to the distance between a sound outlet of the sound-isolating earphone located near the entrance of the external auditory canal and an eardrum located in a deep part of the external auditory canal, and wherein a primary resonant frequency of a both-end closed pipe resonance space formed between the sound outlet and the eardrum is suppressed.

3. The sound-isolating earphone according to claim 1, wherein the at least two electroacoustic transducers are mounted in such a manner that an arrangement axis which connects central points of diaphragms thereof to each other is parallel or generally parallel to the direction of a sound emitted from a sound outlet of the earphone, and wherein sound-emitting directions of the two electroacoustic transducers are oriented in opposite directions.

4. The sound-isolating earphone according to claim 1, wherein an entirety or part of the length of each of the at least two sound leading pipes is made replaceable so as to vary the path length, thereby altering the difference between the path lengths.

5. The sound-isolating earphone according to claim 1, further comprising a regulating valve disposed in one or more of the at least two sound leading pipes at a halfway point thereof, wherein a cross-sectional area of a sound-conducting path is varied by adjusting an inserting position of the regulating valve.

* * * * *